US010345729B2

(12) United States Patent
Sumioka

(10) Patent No.: US 10,345,729 B2
(45) Date of Patent: Jul. 9, 2019

(54) TONER

(71) Applicant: KYOCERA Document Solutions Inc., Osaka (JP)

(72) Inventor: Sho Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/020,106

(22) Filed: Jun. 27, 2018

(65) Prior Publication Data

US 2019/0004443 A1 Jan. 3, 2019

(30) Foreign Application Priority Data

Jun. 29, 2017 (JP) ..... 2017-126864

(51) Int. Cl.
*G03G 9/097* (2006.01)
*G03G 9/093* (2006.01)
*G03G 9/08* (2006.01)

(52) U.S. Cl.
CPC ..... *G03G 9/09321* (2013.01); *G03G 9/0825* (2013.01); *G03G 9/09733* (2013.01)

(58) Field of Classification Search
CPC ..... G03G 9/097; G03G 9/09733
See application file for complete search history.

(56) References Cited

U.S. PATENT DOCUMENTS

2018/0329323 A1* 11/2018 Kimura ..... G03G 9/0825

FOREIGN PATENT DOCUMENTS

JP H08-022142 A 1/1996

* cited by examiner

*Primary Examiner* — Peter L Vajda
(74) *Attorney, Agent, or Firm* — Studebaker & Brackett PC

(57) ABSTRACT

Toner particles each include a toner mother particle and a plurality of C/S external additive particles. The toner mother particle contains a polyester resin. The C/S external additive particles each adhere to a surface of the toner mother particle and include a core particle and a plurality of shell particles. The shell particles each adhere to a surface of the core particle. The shell particles have a number average primary particle diameter of no greater than 0.40 times a number average primary particle diameter of the core particles. The core particles and the shell particles each contain a resin. The core particles have a hydrophobicity degree of at least 30%. The shell particles have a hydrophobicity degree of no greater than 5%. The C/S external additive particles have a hydrophobicity degree of at least 15% and no greater than 25%.

10 Claims, 1 Drawing Sheet

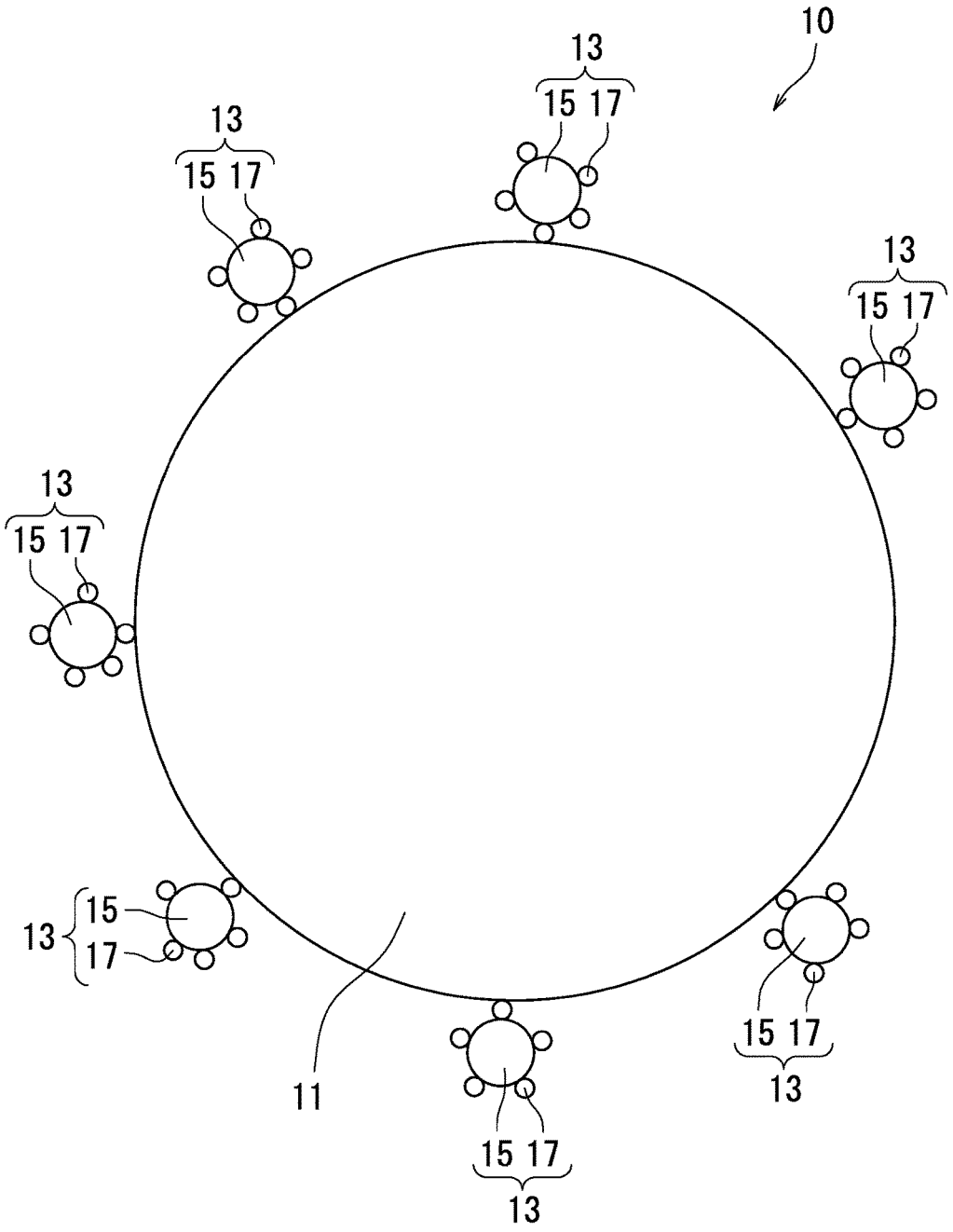
10
13
15 17
13
15 17
13
15 17
13
15 17
13
15
17
11
15 17
13
15 17
13

TONER

INCORPORATION BY REFERENCE

The present application claims priority under 35 U.S.C. § 119 to Japanese Patent Application No. 2017-126864, filed on Jun. 29, 2017. The contents of this application are incorporated herein by reference in their entirety.

BACKGROUND

The present disclosure relates to a toner and particularly to a toner including toner particles that include an external additive.

A toner used for development of electrostatic latent images includes a plurality of toner particles. An external additive including a plurality of resin particles is sometimes used in the toner particles.

SUMMARY

A toner according to the present disclosure includes a plurality of toner particles. The toner particles each include a toner mother particle containing a binder resin and an external additive adhering to a surface of the toner mother particle. The binder resin includes a polyester resin. The external additive includes a plurality of external additive particles having a core-shell structure. The external additive particles having the core-shell structure each include a core particle and a plurality of shell particles adhering to a surface of the core particle. The shell particles have a number average primary particle diameter of no greater than 0.40 times a number average primary particle diameter of the core particles. The core particles and the shell particles each contain a resin. The core particles have a hydrophobicity degree of at least 30%. The shell particles have a hydrophobicity degree of no greater than 5%. The external additive particles having the core-shell structure have a hydrophobicity degree of at least 15% and no greater than 25%.

BRIEF DESCRIPTION OF THE DRAWINGS

FIGURE illustrates an example of a configuration of a toner particle included in a toner according to an embodiment of the present disclosure.

DETAILED DESCRIPTION

The following describes an embodiment of the present disclosure. Note that evaluation results of a powder (i.e., values indicating shape, physical properties, or the like of the powder) are number averages of values obtained through measurement of an appropriate number of particles of the powder, unless otherwise stated. Examples of the powder include toner mother particles, an external additive, and a toner. The term "toner mother particle" refers to a toner particle before attachment of an external additive thereto.

A hydrophobicity degree is determined by a methanol wettability method, and more specifically by a method described in Examples or a method in accordance therewith, unless otherwise stated. A higher hydrophobicity degree indicates stronger hydrophobicity. A lower hydrophobicity degree indicates stronger hydrophilicity.

A number average particle diameter of a powder is a number average value of equivalent circle diameters (Heywood diameters: diameters of circles having the same areas as projected areas of particles) of primary particles of the powder measured using a microscope, unless otherwise stated. A volume median diameter ($D_{50}$) of a powder is a value measured based on the Coulter principle (electrical sensing zone method) using "Coulter Counter Multisizer 3" manufactured by Beckman Coulter, Inc., unless otherwise stated.

A glass transition point (Tg) is a value measured in accordance with "Japanese Industrial Standard (JIS) K7121-2012" using a differential scanning calorimeter ("DSC-6220" manufactured by Seiko Instruments Inc.), unless otherwise stated. A softening point (Tm) is a value measured using a capillary rheometer ("CFT-500D" manufactured by Shimadzu Corporation), unless otherwise stated. On an S-shaped curve (horizontal axis: temperature, vertical axis: stroke) plotted using the capillary rheometer, a temperature at which the stroke value is "(base line stroke value+maximum stroke value)/2" corresponds to the softening point (Tm). A measured value for the melting point (Mp) is a temperature of a peak indicating maximum heat absorption on a heat absorption curve (vertical axis: heat flow (DSC signal), horizontal axis: temperature) plotted using a differential scanning calorimeter ("DSC-6220" manufactured by Seiko Instruments Inc.), unless otherwise stated. A peak indicating heat absorption appears due to melting of a crystallized portion.

The term "main component" of a material refers to a component that accounts for the largest proportion among components of the material on the mass basis, unless otherwise stated.

In the following description, the term "-based" is appended to the name of a chemical compound in order to form a generic term encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term for both acryl and methacryl. The term "(meth) acrylonitrile" is used as a generic term for both acrylonitrile and methacrylonitrile.

A toner according to the present embodiment is an electrostatic latent image developing toner that can be suitably used for development of electrostatic latent images. The toner according to the present embodiment is for example a positively chargeable toner. The toner according to the present embodiment may be used as a one-component developer. A positively chargeable toner used as a one-component developer is positively charged through friction against a development sleeve or a blade within a developing device. Alternatively, the toner may be mixed with a carrier using a mixer (for example, a ball mill) to prepare a two-component developer. A positively chargeable toner included in a two-component developer is positively charged through friction against a carrier within the developing device.

The toner according to the present embodiment can be used for image formation for example in an electrophotographic apparatus (image forming apparatus). Preferably, the electrophotographic apparatus includes a charger and a light exposure device as an image forming device. Preferably, the electrophotographic apparatus further includes a developing device, a transfer device, and a fixing device. The following describes an example of image formation methods performed by the electrophotographic apparatus.

The image forming device of the electrophotographic apparatus initially forms an electrostatic latent image on a photosensitive member based on image data. In a subsequent development process, the developing device (specifically, the developing device loaded with a developer including a toner) of the electrophotographic apparatus supplies the toner to the photosensitive member to develop the electrostatic latent image formed on the photosensitive member. The toner is charged through friction against a carrier, a development sleeve, or a blade within the developing device before being supplied to the photosensitive member. For example, a positively chargeable toner is positively charged. In the development process, the toner (specifically, the charged toner) on the development sleeve located in the vicinity of the photosensitive member is supplied to the photosensitive member and attached to the electrostatic latent image, which is a part of the photosensitive member exposed to light, whereby a toner image is formed on the photosensitive member. A toner in an amount corresponding to that consumed in the development process is supplied to the developing device from a toner container accommodating the toner for replenishment use. Note that the photosensitive member corresponds to a surface layer portion of a photosensitive drum, for example. The development sleeve corresponds to a surface layer portion of a development roller within the developing device, for example.

In a subsequent transfer process, the transfer device of the electrophotographic apparatus transfers the toner image on the photosensitive member onto an intermediate transfer member and then further transfers the toner image from the intermediate transfer member onto a recording medium. Thereafter, the fixing device of the electrophotographic apparatus applies heat and pressure to the toner to fix the toner to the recording medium. As a result, an image is formed on the recording medium. For example, a full-color image can be formed by superimposing toner images in respective four colors of black, yellow, magenta, and cyan. After the transfer process, a toner remaining on the photosensitive member is removed by a cleaning member. Note that an example of the intermediate transfer member is a transfer belt. An example of the recording medium is printing paper. An example of the cleaning member is a cleaning blade. The transfer process is not limited to an indirect transfer process. A direct transfer process may be employed. In the direct transfer process, the toner image on the photosensitive member is transferred directly to the recording medium not via the intermediate transfer member. Also, either of a nip fixing process performed by a heating roller and a pressure roller and a belt fixing process may be employed.

[Basic Features of Toner]

The toner according to the present embodiment has the following features (hereinafter referred to as "basic features"). Specifically, the toner according to the present embodiment includes a plurality of toner particles. The toner particles each include a toner mother particle containing a binder resin and an external additive adhering to a surface of the toner mother particle. The binder resin includes a polyester resin. The external additive includes a plurality of external additive particles having a core-shell structure (hereinafter referred to as "C/S external additive particles"). The C/S external additive particles each include a core particle and a plurality of shell particles adhering to a surface of the core particle. The shell particles have a number average primary particle diameter of no greater than 0.40 times a number average primary particle diameter of the core particles. The core particles and the shell particles each contain a resin. The core particles have a hydrophobicity degree of at least 30%. The shell particles have a hydrophobicity degree of no greater than 5%. The C/S external additive particles have a hydrophobicity degree of at least 15% and no greater than 25%.

As described above, the external additive includes the plurality of C/S external additive particles in the present embodiment. The C/S external additive particles each include the core particle and the plurality of shell particles adhering to the surface of the core particle. In the C/S external additive particles, the shell particles have a number average primary particle diameter of no greater than 0.40 times a number average primary particle diameter of the core particles. Hydrophobicity of the core particles having a hydrophobicity degree of at least 30% is relatively strong. Hydrophilicity of the shell particles having a hydrophobicity degree of no greater than 5% is stronger than hydrophilicity of the core particles. As a result of the above, in a C/S external additive particle, small-diameter particles having strong hydrophilicity (i.e., the shell particles) adhere to a surface of a large-diameter particle having strong hydrophobicity (i.e., the core particle). Here, it is noted that the stronger hydrophilicity of a particle is, the higher affinity of the particle with the toner mother particles tends to be. This tendency is remarkable when the toner mother particles contain a polyester resin. Therefore, it can be ensured that the shell particles of the C/S external additive particles have sufficient affinity with the toner mother particles. Accordingly, it can be ensured that the C/S external additive particles have sufficient affinity with the toner mother particles. The C/S external additive particles are prevented from being detached from the surfaces of the toner mother particles because of their sufficient affinity with the toner mother particles.

In the C/S external additive particles, the shell particles have a number average primary particle diameter of no greater than 0.40 times a number average primary particle diameter of the core particles. Further, the core particles have a hydrophobicity degree of at least 30% and the shell particles have a hydrophobicity degree of no greater than 5%. In the above configuration, the C/S external additive particles can have a hydrophobicity degree of at least 15% and no greater than 25%. Therefore, surfaces of the toner particles can be appropriately hydrophobized while sufficient affinity of the C/S external additive particles with the toner mother particles is ensured. As a result, heat resistance of the toner and charge characteristics of the toner are improved. For example, even when image formation is performed in an environment of high temperature and high humidity, aggregation of the toner particles and charge decay of the toner can be prevented.

As described above, the stronger hydrophilicity of a particle is, the higher affinity of the particle with the toner mother particles tends to be. Therefore, external additive particles having an excessively high hydrophobicity degree are difficult to have sufficient affinity with the toner mother particles. Such external additive particles may be detached from the surfaces of the toner mother particles. As a result, heat resistance of the toner may deteriorate (see Comparative examples 2 and 4).

By contrast, in a situation in which the hydrophobicity degree of the external additive particles is excessively low, moisture tends to adhere to the surfaces of the toner particles. As a result, the charge characteristics of the toner may deteriorate. Particularly, considerable charge decay of the toner occurs when image formation is performed in an environment of high temperature and high humidity (see Comparative examples 1 and 3).

As another method for hydrophilizing a surface of a particle having strong hydrophobicity (i.e., a hydrophobic particle), it can be considered treating the surface of the hydrophobic particle with a treatment agent having strong hydrophilicity, for example. However, effect of the treatment with the treatment agent tends to be caused uniformly over the surface of the hydrophobic particle through this method. As a result, the hydrophobicity degree of the external additive particles may become excessively low. The same result may also be caused when the surface of the hydrophobic particle is covered with a film having strong hydrophilicity (i.e., a hydrophilic film).

Preferably, a ratio of an area of surface regions of the core particle covered by the shell particles to an entire surface area of the core particle (hereinafter referred to as a "coverage ratio of the shell particles") is at least 20% and no greater than 30%. In a configuration in which the coverage ratio of the shell particles is at least 20% and no greater than 30%, the hydrophobicity degree of the C/S external additive particles tends to be at least 15% and no greater than 25%. Note that the coverage ratio of the shell particles is measured by a method described in Examples or a method in accordance therewith.

The following describes the toner having the above-described basic features with reference to FIGURE. FIGURE illustrates an example of a configuration of a toner particle included in the toner according to the present embodiment. A toner particle 10 illustrated in FIGURE includes a toner mother particle 11 and a plurality of C/S external additive particles 13. The toner mother particle 11 contains a polyester resin. The C/S external additive particles 13 each adhere to a surface of the toner mother particle 11 and include a core particle 15 and a plurality of shell particles 17. The shell particles 17 each adhere to a surface of a corresponding one of the core particles 15. The shell particles 17 have a number average primary particle diameter of no greater than 0.40 times a number average primary particle diameter of the core particles 15. The core particles 15 and the shell particles 17 each contain a resin. The core particles 15 have a hydrophobicity degree of at least 30%. The shell particles 17 have a hydrophobicity degree of no greater than 5%. The C/S external additive particles 13 have a hydrophobicity degree of at least 15% and no greater than 25%.

In the toner particle 10 illustrated in FIGURE, at least one shell particle 17 is present between the toner mother particle 11 and each of the core particles 15. In this configuration, the shell particles 17 tend to be in contact with the toner mother particle 11. Therefore, sufficient affinity of the C/S external additive particles 13 with the toner mother particle 11 is easily ensured. For example, detachment of the C/S external additive particles 13 from the surface of the toner mother particle 11 can be effectively prevented. Through the above, the configuration of the toner has been specifically described with reference to FIGURE. The following describes materials of the toner and a method for producing the toner in order without reference to FIGURE.

[Examples of Materials of Toner]

<Toner Mother Particles>

The toner mother particles may each include a toner core and a shell layer covering a surface of the toner core. Alternatively, the toner mother particles may each include the toner core only without the shell layer.

(Toner Cores)

The binder resin is typically a major component (for example, at least 85% by mass) of the toner cores. Therefore, properties of the binder resin are thought to have great influence on overall properties of the toner cores. Properties of the binder resin (specific examples include hydroxyl value, acid value, Tg, and Tm) can be adjusted through use of a combination of resins as the binder resin. For example, when the binder resin has an ester group, a hydroxyl group, an ether group, an acid group, or a methyl group, the toner cores have a strong tendency to be anionic. When the binder resin has an amino group, the toner cores have a strong tendency to be cationic.

The toner cores may further contain at least one of a colorant, a releasing agent, and a charge control agent in addition to the binder resin. The following describes examples of respective components of the toner cores in order.

(Binder Resin)

The binder resin includes a polyester resin as a major component. The binder resin may include the polyester resin only or further include a thermoplastic resin other than the polyester resin. Examples of thermoplastic resins other than the polyester resin include styrene-based resins, acrylic acid-based resins, olefin-based resins, vinyl resins, polyamide resins, and urethane resins. Examples of acrylic acid-based resins that can be used include acrylic acid ester polymers and methacrylic acid ester polymers. Examples of olefin-based resins that can be used include polyethylene resins and polypropylene resins. Examples of vinyl resins that can be used include vinyl chloride resins, polyvinyl alcohols, vinyl ether resins, and N-vinyl resins. A copolymer of any of the above-listed resins, that is, a copolymer formed by introduction of a repeating unit into any of the above-listed resins can also be used as a thermoplastic resin for forming the toner particles. For example, a styrene-acrylic acid-based resin or a styrene-butadiene-based resin can also be used as a thermoplastic resin included in the binder resin. The following specifically describes the polyester resin.

(Polyester Resin)

The polyester resin is a copolymer of at least one alcohol and at least one carboxylic acid. Examples of alcohols that can be used for synthesis of the polyester resin include the following dihydric alcohols and tri- or higher-hydric alcohols. Examples of dihydric alcohols that can be used include diols and bisphenols. Examples of carboxylic acids that can be used for synthesis of the polyester resin include the following dibasic carboxylic acids and tri- or higher-basic carboxylic acids.

Preferable examples of diols include aliphatic diols. Preferable examples of aliphatic diols include diethylene glycol, triethylene glycol, neopentyl glycol, 1,2-propanediol, α,ω-alkanediols, 2-buten-1,4-diol, 1,4-cyclohexanedimethanol, dipropylene glycol, polyethylene glycol, polypropylene glycol, and polytetramethylene glycol. Preferable examples of α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Preferable examples of bisphenols include bisphenol A, hydrogenated bisphenol A, bisphenol A ethylene oxide adduct, and bisphenol A propylene oxide adduct.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include aromatic dicarboxylic acids, α,ω-alkanedicarboxylic acids, unsaturated dicarboxylic acids, and cycloalkane dicarboxylic acids. Preferable examples of aromatic dicarboxylic acids include phthalic acid, terephthalic acid, and isophthalic acid. Preferable examples of α,ω-alkanedicarboxylic acids include malonic acid, succinic acid, adipic acid, suberic acid, azelaic acid, sebacic acid, and 1,10-decanedicarboxylic acid. Preferable examples of unsaturated dicarboxylic acids include maleic acid, fumaric acid, citraconic acid, itaconic acid, and glutaconic acid. Preferable examples of cycloalkane dicarboxylic acids include cyclohexanedicarboxylic acid.

Preferable examples of tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

A known pigment or dye that matches the color of the toner according to the present embodiment can be used as the colorant. The amount of the colorant is preferably at least 1 part by mass and no greater than 20 parts by mass relative to 100 parts by mass of the binder resin in order to form high quality images with the toner according to the present embodiment.

The toner cores may contain a black colorant. Examples of black colorants include carbon black. Alternatively, the black colorant may be a colorant adjusted to the black color using a yellow colorant, a magenta colorant, and a cyan colorant.

The toner cores may contain a non-black colorant such as a yellow colorant, a magenta colorant, or a cyan colorant.

At least one compound selected from the group consisting of condensed azo compounds, isoindolinone compounds, anthraquinone compounds, azo metal complexes, methine compounds, and arylamide compounds can for example be used as the yellow colorant. Specific examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Specific examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as the cyan colorant. Specific examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent is used for example in order to improve fixability or hot offset resistance of the toner according to the present embodiment. In order to obtain strongly cationic toner cores, it is preferable to produce the toner cores using a cationic wax.

Preferable examples of the releasing agent include aliphatic hydrocarbon waxes, plant waxes, animal waxes, mineral waxes, waxes containing a fatty acid ester as a major component, and waxes in which a fatty acid ester is partially or wholly deoxidized. Preferable examples of aliphatic hydrocarbon waxes include low molecular weight polyethylene, low molecular weight polypropylene, polyolefin copolymer, polyolefin wax, microcrystalline wax, paraffin wax, and Fischer-Tropsch wax. Oxides of the above-listed aliphatic hydrocarbon waxes can also be used. Preferable examples of plant waxes include candelilla wax, carnauba wax, Japan wax, jojoba wax, and rice wax. Preferable examples of animal waxes include beeswax, lanolin, and spermaceti. Preferable examples of mineral waxes include ozokerite, ceresin, and petrolatum. Preferable examples of waxes containing a fatty acid ester as a major component include montanic acid ester wax and castor wax. A wax may be used alone or a plurality of waxes may be used in combination.

In order to improve compatibility between the binder resin and the releasing agent, a compatibilizer may be added to the toner cores.

(Charge Control Agent)

The charge control agent is used for example in order to improve charge stability or a charge rise characteristic of the toner according to the present embodiment. The charge rise characteristic of the toner according to the present embodiment is an indicator as to whether or not the toner can be charged to a specific level in a short period of time. The toner cores can be made more strongly cationic through inclusion of a positively chargeable charge control agent in the toner cores. The toner cores can be made more strongly anionic through inclusion of a negatively chargeable charge control agent in the toner cores.

<Shell Layer>

Preferably, the shell layer contains a thermoplastic resin. In a configuration in which the shell layer contains a thermoplastic resin, the toner can have both heat-resistant preservability and low-temperature fixability. In a configuration in which the shell layer contains a styrene-acrylic acid-based resin, the toner can have improved charge stability as well as heat-resistant preservability and low-temperature fixability. Therefore, the shell layer preferably contains a styrene-acrylic acid-based resin. Further, in a configuration in which the shell layer contains a resin that has a unit having at least one species of alcoholic hydroxyl group derived from 2-hydroxyethyl acrylate, 2-hydroxypropyl acrylate, 2-hydroxyethyl methacrylate, or 2-hydroxypropyl methacrylate, film quality of the shell layer can be improved.

The styrene-acrylic acid-based resin is a copolymer of at least one styrene-based monomer and at least one acrylic acid-based monomer. Preferable examples of styrene-based monomers that can be used for synthesis of the styrene-acrylic acid-based resin include styrene, alkylstyrenes, hydroxystyrenes, and halogenated styrenes. Preferable examples of alkylstyrenes include α-methylstyrene, m-methylstyrene, p-methylstyrene, p-ethylstyrene, and 4-tert-butylstyrene. Preferable examples of hydroxystyrenes include p-hydroxystyrene and m-hydroxystyrene. Preferable examples of halogenated styrenes include α-chlorostyrene, o-chlorostyrene, m-chlorostyrene, and p-chlorostyrene.

Preferable examples of acrylic acid-based monomers that can be used for synthesis of the styrene-acrylic acid-based resin include (meth)acrylic acid, (meth)acrylamide, (meth) acrylonitrile, (meth)acrylic acid alkyl esters, and (meth) acrylic acid hydroxyalkyl esters. Preferable examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Preferable examples of (meth)acrylic acid hydroxyalkyl esters include 2-hydroxyethyl (meth)acrylate, 3-hydroxypropyl (meth) acrylate, 2-hydroxypropyl (meth)acrylate, and 4-hydroxybutyl (meth)acrylate.

<External Additive>

Unlike internal additives, the external additive is not present within the toner mother particles and is present selectively only on the surfaces of the toner mother particles. External additive particles do not chemically react with the toner mother particles. The toner mother particles and the external additive particles physically bond together. The external additive includes the plurality of C/S external additive particles. The external additive may further include external additive particles (hereinafter referred to as "additional external additive particles") other than the C/S external additive particles.

The amount of the external additive is preferably at least 0.5 parts by mass and no greater than 10 parts by mass relative to 100 parts by mass of the toner mother particles. When the toner particles include two or more types of external additive particles, a total amount of the external additive particles is preferably at least 0.5 parts by mass and no greater than 10 parts by mass relative to 100 parts by mass of the toner mother particles.

(C/S External Additive Particles)

Preferably, the shell particles have a number average primary particle diameter of at least 0.05 times and no greater than 0.40 times a number average primary particle diameter of the core particles, more preferably at least 0.10 times and no greater than 0.35 times the number average primary particle diameter of the core particles, and further preferably at least 0.10 times and no greater than 0.25 times the number average primary particle diameter of the core particles. The number average primary particle diameter of the core particles is preferably at least 70 nm and no greater than 110 nm, and more preferably at least 80 nm and no greater than 100 nm. The number average primary particle diameter of the shell particles is preferably at least 5 nm and no greater than 25 nm, and more preferably at least 10 nm and no greater than 20 nm.

The hydrophobicity degree of the core particles is at least 30%, preferably at least 30% and no greater than 60%, and more preferably at least 35% and no greater than 60%. The hydrophobicity degree of the shell particles is no greater than 5%, and preferably at least 1% and no greater than 5%.

The hydrophobicity degree of the core particles tends to be high in a configuration in which a resin contained in the core particles (hereinafter referred to as a "core resin") is a homopolymer of a hydrophobic monomer or a copolymer of monomers including a hydrophobic monomer. The hydrophobicity degree of the shell particles tends to be low in a configuration in which a resin contained in the shell particles (hereinafter referred to as a "shell resin") is a homopolymer of a hydrophilic monomer or a copolymer of monomers including a hydrophilic monomer. Further, the core particles can have sufficient hardness in a configuration in which the core resin is a crosslinked resin. Also, the shell particles can have sufficient hardness in a configuration in which the shell resin is a crosslinked resin. As a result, the C/S external additive particles tend to function as spacers. Examples of preferable combinations of the core resin and the shell resin include the following first through third combinations.

First combination: The core resin is a copolymer of a cross-linking agent and at least one acrylic acid-based monomer including a strongly hydrophobic acrylic acid-based monomer. The shell resin is a copolymer of a cross-linking agent and a strongly hydrophilic acrylic acid-based monomer.

Second combination: The core resin is a crosslinked styrene-acrylic acid-based resin. The shell resin is a crosslinked acrylic acid-based resin.

Third combination: The core resin is a crosslinked styrene-based resin. The shell resin is a crosslinked acrylic acid-based resin.

(First Combination)

The strongly hydrophobic acrylic acid-based monomer is insoluble in water. By contrast, the strongly hydrophilic acrylic acid-based monomer is soluble in water. Examples of the first combination include the following combination. When the following combination of the core resin and the shell resin is employed, the core particles tend to have a hydrophobicity degree of at least 30% and the shell particles tend to have a hydrophobicity degree of no greater than 5%.

Core resin: The core resin is a copolymer of a cross-linking agent and at least one acrylic acid-based monomer including a (meth)acrylic acid alkyl ester that has an alkyl group having a carbon number of at least 4 and no greater than 8 (hereinafter referred to as a "first (meth)acrylic acid alkyl ester"). The first (meth)acrylic acid alkyl ester is for example n-butyl (meth)acrylate.

Shell resin: The shell resin is a copolymer of a cross-linking agent and a (meth)acrylic acid alkyl ester that has an alkyl group having a carbon number of at least 1 and no greater than 2 (hereinafter referred to as a "second (meth) acrylic acid alkyl ester"). The second (meth)acrylic acid alkyl ester is for example methyl (meth)acrylate.

(Second and Third Combinations)

Styrene-based monomers have stronger hydrophobicity than acrylic acid-based monomers. Therefore, any of the styrene-based monomers described above in <Shell Layer> can be used as a styrene-based monomer for synthesis of the crosslinked styrene-acrylic acid-based resin and as a styrene-based monomer for synthesis of the crosslinked styrene-based resin. Also, any of the acrylic acid-based monomers described above in <Shell Layer> can be used as an acrylic acid-based monomer for synthesis of the crosslinked styrene-acrylic acid-based resin and as an acrylic acid-based monomer for synthesis of the crosslinked acrylic acid-based resin. Preferable examples of the second combination include the following combination. When the following combination of the core resin and the shell resin is employed, the core particles tend to have a hydrophobicity degree of at least 30% and the shell particles tend to have a hydrophobicity degree of no greater than 5%.

Core resin: The core resin is a copolymer of a cross-linking agent, a styrene-based monomer, and at least one acrylic acid-based monomer including the first (meth)acrylic acid alkyl ester. The first (meth)acrylic acid alkyl ester is for example n-butyl (meth)acrylate.

Shell resin: The shell resin is a copolymer of a cross-linking agent and the second (meth)acrylic acid alkyl ester. The second (meth)acrylic acid alkyl ester is for example methyl (meth)acrylate.

(Cross-Linking Agent)

A compound having at least two vinyl groups in a molecule thereof is preferable as a cross-linking agent. Examples of compounds having two vinyl groups in a molecule thereof that can be used include aromatic divinyl compounds, ethylene glycol dimethacrylate, diethylene glycol methacrylate, triethylene glycol methacrylate, aryl methacrylate, tert-butyl aminoethyl methacrylate, tetraethylene glycol methacrylate, 1,3-butanediol dimethacrylate, N,N-divinyl aniline, divinyl ether, divinyl sulfide, and divinyl sulfone. Preferable examples of aromatic divinyl compounds include divinylbenzene, divinyl naphthalene, and derivatives of divinyl benzene and divinyl naphthalene. One or more of the above-listed compounds having two vinyl groups in a molecule thereof can be used. Examples of compounds having at least three vinyl groups in a molecule thereof that can be used include trimethylolpropane triacrylate and tetramethylolpropane triacrylate.

(Additional External Additive Particles)

Preferably, the additional external additive particles are inorganic particles. Preferably, the inorganic particles are silica particles or particles of a metal oxide. Preferably, the metal oxide is alumina, titanium oxide, magnesium oxide, zinc oxide, strontium titanate, or barium titanate. The additional external additive particles may be particles of an organic acid compound such as a fatty acid metal salt. Preferable examples of the fatty acid metal salt include zinc stearate.

[Method for Producing Toner]

The toner according to the present embodiment is preferably produced by a method including production of the toner mother particles, production of the C/S external additive particles, and addition of the external additive.

<Production of Toner Mother Particles>

In a configuration in which the toner mother particles each include a toner core and a shell layer, production of the toner mother particles includes production of toner cores and formation of shell layers. In a configuration in which the toner mother particles do not include shell layers, production of the toner mother particles includes production of the toner cores but does not include formation of shell layers.

The toner cores are preferably produced by a known pulverization method or a known aggregation method. The toner cores can be easily produced by either of these methods. A resin including a polyester resin as a major component is used as the binder resin in the present embodiment.

The shell layers are preferably formed on surfaces of the toner cores for example by in-situ polymerization, in-liquid curing film coating, or coacervation.

<Production of C/S External Additive Particles>

Production of the C/S external additive particles preferably includes production of the core particles, production of the shell particles, and attachment of the shell particles.

In production of the core particles, emulsion polymerization of a monomer having an unsaturated bond within a molecule thereof is performed in an aqueous medium. The resultant emulsion is dried. Through the above, the core particles are produced. Core particles produced at the same time are thought to have substantially the same configuration. The particle diameter of the core particles to be obtained can be changed by changing conditions of stirring the monomer in the aqueous medium during emulsion polymerization of the monomer.

Preferably, the aqueous medium is water or a dispersion medium including water as a major component. When the aqueous medium is water, the water is preferably ion exchanged water or pure water. Preferably, the dispersion medium including water as a major component further includes at least one of an emulsifier and a polymerization initiator. Preferable examples of the emulsifier include cetyltrimethylammonium chloride. Preferable examples of the polymerization initiator include benzoyl peroxide. Examples of monomers having an unsaturated bond within a molecule thereof include a monomer that serves as a cross-linking agent.

The shell particles can be produced by a method similar to that employed in production of the core particles. The particle diameter of the shell particles to be obtained can be changed by changing conditions of stirring a monomer in the aqueous medium in emulsion polymerization of the monomer.

In attachment of the shell particles, the shell particles are attached to surfaces of the core particles. Preferably, C/S external additive particles having a high coverage ratio of the shell particles (hereinafter referred to as "High-C/S external additive particles") are produced and then a treatment for decreasing the coverage ratio of the shell particles is performed, for example. The High-C/S external additive particles can be produced by attaching the shell particles to the surfaces of the core particles using a surface modification machine (for example, "MR-2" manufactured by Nippon Pneumatic Mfg. Co., Ltd.). The coverage ratio of the shell particles can be decreased by mixing the High-C/S external additive particles and pulverization balls using a mixer (for example, NAUTA MIXER (registered Japanese trademark) manufactured by Hosokawa Micron Corporation). The coverage ratio of the shell particles tends to decrease with an increase of a time for which the High-C/S external additive particles and the pulverization balls are mixed. Examples of the pulverization balls include zirconia beads (product of Tosoh Corporation, for example).

<Addition of External Additive>

The toner mother particles and the external additive are mixed using a mixer (for example, FM mixer manufactured by Nippon Coke & Engineering Co., Ltd.). Through the mixing, the external additive physically bonds to the surfaces of the toner mother particles. As a result, a toner including a large number of toner particles is obtained.

Examples

The following describes examples of the present disclosure. Table 1 shows respective compositions of toners TA-1 to TA-6 and TB-1 to TB-4 according to the examples and comparative examples. In Table 1, a coverage ratio of shell particles is shown in the column titled "Coverage ratio". A time of mixing performed using NAUTA MIXER manufactured by Hosokawa Micron Corporation is shown in the column titled "Mixing time". Mixing using NAUTA MIXER was not performed in production of C/S external additive particles P-9. Shell particles were not used in production of C/S external additive particles P-10.

TABLE 1

| | C/S external additive particles | | | | | |
|---|---|---|---|---|---|---|
| Toner | Type | Core particles | Shell particles | Hydrophobicity degree (%) | Coverage ratio (%) | Mixing time (minute) |
| TA-1 | P-1 | C-1 | S-1 | 15 | 30 | 20 |
| TA-2 | P-2 | C-1 | S-1 | 20 | 25 | 22 |
| TA-3 | P-3 | C-1 | S-1 | 25 | 20 | 24 |
| TA-4 | P-4 | C-1 | S-2 | 15 | 30 | 20 |
| TA-5 | P-5 | C-2 | S-1 | 25 | 20 | 24 |
| TA-6 | P-6 | C-3 | S-3 | 15 | 30 | 20 |
| TB-1 | P-7 | C-1 | S-1 | 13 | 35 | 18 |
| TB-2 | P-8 | C-1 | S-1 | 27 | 15 | 26 |
| TB-3 | P-9 | C-1 | S-1 | 3 | 100 | 0 |
| TB-4 | P-10 | C-1 | — | 40 | 0 | 0 |

Table 2 shows respective compositions of core particles C-1 to C-3. Table 3 shows respective compositions of shell particles S-1 to S-3. In Tables 2 and 3, "MMA" represents methyl methacrylate. "EGDMA" represents ethylene glycol dimethacrylate. "Particle diameter" represents number average primary particle diameter. In Table 2, "BMA" represents n-butyl methacrylate.

TABLE 2

| Core particles | Material | Monomers | Particle diameter (nm) | Hydrophobicity degree (%) |
|---|---|---|---|---|
| C-1 | Acrylic acid-based resin | BMA, MMA, and EGDMA | 100 | 40 |
| C-2 | Acrylic acid-based resin | BMA, MMA, and EGDMA | 80 | 40 |
| C-3 | Styrene-based resin | Styrene and EGDMA | 100 | 42 |

TABLE 3

| Shell particles | Material | Monomers | Particle diameter (nm) | Hydrophobicity degree (%) |
|---|---|---|---|---|
| S-1 | Acrylic acid-based resin | MMA and EGDMA | 10 | 3 |
| S-2 | Acrylic acid-based resin | MMA and EGDMA | 20 | 3 |
| S-3 | Acrylic acid-based resin | MMA and EGDMA | 10 | 2 |

The following describes production methods of the core particles C-1 to C-3, production methods of the shell particles S-1 to S-3, and production methods of C/S external additive particles P-1 to P-10 in order. Next, methods for measuring physical property values of the C/S external additive particles P-1 to P-10 will be described. Then, production methods, evaluation methods, and evaluation results of the toners according to the examples and the comparative examples will be described. In evaluations in which errors may occur, an evaluation value was calculated by calculating an arithmetic mean of an appropriate number of measured values so that any errors were sufficiently small.

[Production Methods of Core Particles]

<Production of Core Particles C-1>

A four-necked flask (capacity: 1,000 mL) equipped with a stirrer, a cooling tube, a thermometer, and a nitrogen inlet tube was prepared. Then, 140 g of n-butyl methacrylate (BMA), 20 g of methyl methacrylate (MMA), 4 g of ethylene glycol dimethacrylate (EGDMA, cross-linking agent), 12 g of cetyltrimethylammonium chloride (CTAC, emulsifier), 15 g of benzoyl peroxide (BPO, polymerization initiator), and 600 g of ion exchanged water were put into the flask under stirring. The internal temperature of the flask was increased up to 90° C. The internal temperature of the flask was kept at 90° C. for 3 hours while nitrogen was introduced into the flask and the flask contents were stirred. Conditions of stirring of the flask contents were adjusted so that resin particles to be obtained have a particle diameter of 100 nm. The flask contents reacted together while the internal temperature of the flask was kept at 90° C. The resultant emulsion (emulsion containing the resin particles) was cooled and then subjected to suction filtration. The resultant solid was washed and then dried. Through the above, a powder including a large number of the core particles C-1 was obtained. The obtained core particles C-1 had a sharp particle size distribution. More specifically, the core particles C-1 substantially included only acrylic acid-based resin particles having a particle diameter of approximately 100 nm.

<Production of Core Particles C-2>

The amount of cetyltrimethylammonium chloride was changed to 16 g. Conditions of stirring of the flask contents were adjusted so that resin particles to be obtained have a particle diameter of 80 nm. A powder including a large number of the core particles C-2 was obtained by the same method as that for producing the core particles C-1 in all aspects other than the above changes. The obtained core particles C-2 had a sharp particle size distribution. More specifically, the core particles C-2 substantially included only acrylic acid-based resin particles having a particle diameter of approximately 80 nm.

<Production of Core Particles C-3>

First, 160 g of styrene, 4 g of ethylene glycol dimethacrylate, 12 g of cetyltrimethylammonium chloride, 15 g of benzoyl peroxide, and 600 g of ion exchanged water were put into the flask under stirring. A powder including a large number of the core particles C-3 was obtained by the same method as that for producing the core particles C-1 in all aspects other than the above change. The obtained core particles C-3 had a sharp particle size distribution. More specifically, the core particles C-3 substantially included only styrene-based resin particles having a particle diameter of approximately 100 nm.

[Production Methods of Shell Particles]

<Production of Shell Particles S-1>

A four-necked flask (capacity: 1,000 mL) equipped with a stirrer, a cooling tube, a thermometer, and a nitrogen inlet tube was prepared. Then, 160 g of methyl methacrylate, 4 g of ethylene glycol dimethacrylate, 24 g of cetyltrimethylammonium chloride, 15 g of benzoyl peroxide, and 600 g of ion exchanged water were put into the flask under stirring. The internal temperature of the flask was increased up to 90° C. The internal temperature of the flask was kept at 90° C. for 3 hours while nitrogen was introduced into the flask and the flask contents were stirred. Conditions of stirring of the flask contents were adjusted so that resin particles to be obtained have a particle diameter of 10 nm. The flask contents reacted together while the internal temperature of the flask was kept at 90° C. The resultant emulsion (emulsion containing the resin particles) was cooled and then subjected to suction filtration. The resultant solid was washed and then dried. Through the above, a powder including a large number of resin particles (hereinafter referred to as a "powder M") was obtained.

A four-necked flask (capacity: 200 mL) equipped with a stirrer, a cooling tube, a thermometer, and a nitrogen inlet tube was prepared. Then, 5 g of the powder M, 10 g of 4,4'-diaminodiphenylmethane, and 50 mL of toluene were put into the flask. The internal temperature of the flask was increased up to 120° C. The internal temperature of the flask was kept at 120° C. for 3 hours while nitrogen was introduced into the flask and the flask contents were stirred. The resultant dispersion (dispersion containing resin particles) was cooled and then subjected to suction filtration. The resultant solid was washed and then dried. Through the above, a powder including a large number of the shell particles S-1 was obtained. The obtained shell particles S-1 had a sharp particle size distribution. More specifically, the shell particles S-1 substantially included only acrylic acid-based resin particles having a particle diameter of approximately 10 nm.

<Production of Shell Particles S-2>

The amount of cetyltrimethylammonium chloride was changed to 22 g. In production of an emulsion, conditions of stirring of the flask contents were adjusted so that resin particles to be obtained have a particle diameter of 20 nm. The amount of 4,4'-diaminodiphenylmethane was changed to 20 g. A powder including a large number of the shell particles S-2 was obtained by the same method as that for producing the shell particles S-1 in all aspects other than the above changes. The obtained shell particles S-2 had a sharp particle size distribution. More specifically, the shell particles S-2 substantially included only acrylic acid-based resin particles having a particle diameter of approximately 20 nm.

<Production of Shell Particles S-3>

The powder M was obtained in the same manner as that employed in production of the shell particles S-1. A three-necked flask (capacity: 200 mL) equipped with a stirrer, a cooling tube, and a thermometer was set in a water bath (set temperature: 30° C.). The flask was charged with 50 mL of ion exchanged water and then the pH of the flask content was adjusted to 4 using hydrochloric acid. Then, 1 mL of an aqueous solution of a hexamethylol melamine prepolymer ("MIRBANE (registered Japanese trademark) RESIN SM-607" manufactured by Showa Denko K.K., solid concentration: 80% by mass) and 50 g of the powder M were added into the flask in order and then the flask contents were stirred. Further, 50 mL of ion exchanged water was added into the flask. The internal temperature of the flask was increased up to 60° C. and kept at 60° C. for 2 hours while the flask contents were stirred. Through the above, a dispersion of resin particles was obtained. The obtained dispersion was cooled and then subjected to suction filtration. The resultant solid was washed and then dried. As a result, a powder including a large number of the shell particles S-3 was obtained. The obtained shell particles S-3 had a sharp particle size distribution. More specifically, the shell particles S-3 substantially included only acrylic acid-based resin particles having a particle diameter of approximately 10 nm.

[Production Methods of C/S External Additive Particles]

<Production of C/S External Additive Particles P-1>

First, 100 g of the core particles C-1, 110 g of the shell particles S-1, and 200 g of ethanol were put into a beaker (capacity: 500 mL). The beaker contents were stirred and then dried. The shell particles S-1 were attached to surfaces of the core particles C-1 using a surface modification machine ("MR-2" manufactured by Nippon Pneumatic Mfg. Co., Ltd.) under conditions of: treatment temperature of 160° C.; feeding rate of 2 kg/h; and treatment amount of 200 g. Through the above, a powder including a large number of High-C/S external additive particles was obtained.

A polyethylene vessel (capacity: 500 mL) was charged with 5 g of the High-C/S external additive particles and 200 g of zirconia beads (product of Tosoh Corporation, diameter: 300 μm). The vessel contents were mixed for 20 minutes at a rotational speed of 100 rpm using NAUTA MIXER manufactured by Hosokawa Micron Corporation. The resultant mixture was sifted using a sieve having an opening size of 250 μm. A powder passed through the sieve was dispersed in ion exchanged water. The resultant dispersion was separated into the C/S external additive particles P-1 and the shell particles S-1 by centrifugation. Through the above, a powder including a large number of the C/S external additive particles P-1 was obtained.

<Production of C/S External Additive Particles P-2 to P-10>

The C/S external additive particles P-2 and P-3 were produced by the same method as that for producing the C/S external additive particles P-1 in all aspects other than that the time of mixing performed using NAUTA MIXER was changed to 22 minutes in production of the C/S external additive particles P-2 and 24 minutes in production of the C/S external additive particles P-3.

The C/S external additive particles P-4 were produced by the same method as that for producing the C/S external additive particles P-1 in all aspects other than that the shell particles S-2 were used.

The C/S external additive particles P-5 were produced by the same method as that for producing the C/S external additive particles P-1 in all aspects other than that the core particles C-2 were used and the time of mixing performed using NAUTA MIXER was changed to 24 minutes.

The C/S external additive particles P-6 were produced by the same method as that for producing the C/S external additive particles P-1 in all aspects other than that the core particles C-3 and the shell particles S-3 were used.

The C/S external additive particles P-7 and P-8 were produced by the same method as that for producing the C/S external additive particles P-1 in all aspects other than that the time of mixing performed using NAUTA MIXER was changed to 18 minutes in production of the C/S external additive particles P-7 and 26 minutes in production of the C/S external additive particles P-8.

The C/S external additive particles P-9 were produced by the same method as that for producing the C/S external additive particles P-1 in all aspects other than that mixing using NAUTA MIXER, sifting, preparation of a dispersion, and centrifugation were not performed.

The C/S external additive particles P-10 were produced by the same method as that for producing the C/S external additive particles P-1 in all aspects other than that the shell particles S-1 were not attached to the surfaces of the core particles C-1. That is, the C/S external additive particles P-10 were equivalent to the core particles C-1.

[Methods for Measuring Physical Property Values of C/S External Additive Particles]

<Measurement of Hydrophobicity Degree>

Respective hydrophobicity degrees of the core particles (more specifically, the core particles C-1 to C-3), the shell particles (more specifically, the shell particles S-1 to S-3), and the C/S external additive particles (more specifically, the C/S external additive particles P-1 to P-10) were determined by a methanol wettability method.

Specifically, 25 mL of ion exchanged water and 0.1 g of a measurement target (core particles, shell particles, or C/S external additive particles) were put into a beaker (capacity: 100 mL) in an air atmosphere at normal temperature (25° C.) and the beaker contents were stirred for 10 minutes at a rotational speed of 100 rpm using a stirrer. Then, a specific amount of methanol was added into the beaker at a rate of 2 mL/minute and thereafter the beaker contents were stirred for 30 seconds at a rotational speed of 200 rpm. Whether or not the measurement target was wholly precipitated on the bottom of the beaker was visually checked. Addition of methanol and stirring were repeated until it was confirmed that the measurement target was wholly precipitated. Once it was confirmed that the measurement target was wholly precipitated, a hydrophobicity degree of the measurement target was calculated using the following equation.

Hydrophobicity degree (%) of measurement target=100×(addition amount of methanol)/(addition amount of methanol+amount of ion exchanged water)

The following pretreatment was performed before measurement of the hydrophobicity degree of core particles and the hydrophobicity degree of shell particles. Specifically, C/S external additive particles were divided into core particles and shell particles using NAUTA MIXER manufactured by Hosokawa Micron Corporation and zirconia beads (product of Tosoh Corporation, diameter: 300 μm). The resultant core particles were used as a measurement target in measurement of the hydrophobicity degree of the core particles. The resultant shell particles were used as a measurement target in measurement of the hydrophobicity degree of the shell particles.

<Measurement of Coverage Ratio of Shell Particles>

C/S external additive particles (more specifically, any of the C/S external additive particles P-1 to P-10) were exposed to vapor of 2 mL of an aqueous $RuO_4$ solution at a concentration of 5% by mass for 20 minutes in an air atmosphere at normal temperature (25° C.). Through the above, the C/S external additive particles were dyed with Ru. At this time, surface regions of the C/S external additive particles covered by shell particles (more specifically, any of the shell particles S-1 to S-3) tended to be dyed with ruthenium.

Next, a backscattered electron image (surface image) of one of the dyed C/S external additive particles was taken using a field emission scanning electron microscope (FE-SEM, "JSM-7600F" manufactured by JEOL Ltd.). Surface regions of the C/S external additive particle dyed with Ru (dyed regions) looked brighter than surface regions of the C/S external additive particle that were not dyed with Ru (non-dyed regions). Note that the backscattered electron image of the external additive particle was taken under conditions of: accelerating voltage of 10.0 kV; irradiation electric current of 95 μA; magnification of ×250,000; contrast of 4,800; and brightness of 550.

Image analysis of the backscattered electron image was then performed using image analysis software ("WinROOF" manufactured by Mitani Corporation). Specifically, image data of a surface region (2 μm×2 μm) around the center of the C/S external additive particle was obtained from the backscattered electron image and 5×5 Gaussian filtering was performed on the image data. The surface region around the center of the C/S external additive particle was a rectangular region having a size of 2 m×2 μm defined using the center of gravity of the C/S external additive particle in the backscattered electron image as a reference point (i.e., the center of gravity of rectangle). A brightness histogram (vertical axis: frequency (number of pixels), horizontal axis: brightness) of the image data subjected to the filtering (region: 2 μm×2 μm, number of pixels: 1,280×1,024) was obtained. The brightness histogram showed a distribution of brightness values of surface regions (dyed regions and non-dyed regions) of the C/S external additive particle.

Fitting to a normal distribution by the least-squares method and waveform separation were performed on the thus obtained brightness histogram using solver of spreadsheet software ("MICROSOFT EXCEL (registered Japanese trademark)" manufactured by Microsoft Corporation). As a result, a non-dyed region waveform showing a distribution of brightness values of the non-dyed regions (normal distribution on low brightness side) and a dyed region waveform showing a distribution of brightness values of the dyed regions (normal distribution on high brightness side) were obtained. A coverage ratio of shell particles (unit: %) was calculated from respective areas of the obtained two waveforms by the following equation (RC: area of the non-dyed region waveform, RS: area of the dyed region waveform). Note that pixels forming the non-dyed region waveform are thought to indicate a core particle in the image data. Pixels forming the dyed region waveform are thought to indicate the shell particles in the image data. Accordingly, a ratio of an area of surface regions of the core particle covered by the shell particles to an entire surface area of the core particle (i.e., the coverage ratio of the shell particles) can be calculated by the following equation.

$$\text{Coverage ratio of shell particles}=100\times RS/(RC+RS)$$

[Methods for Producing Toners]

<Production of Toner TA-1>

A bisphenol A ethylene oxide adduct (specifically, an alcohol formed by addition of ethylene oxide to a bisphenol A backbone) and para-phthalic acid were caused to react in the presence of titanium dioxide (catalyst). Through the above, a polyester resin was obtained. The obtained polyester resin had a hydroxyl value (OHV) of 20 mgKOH/g, an acid value (AV) of 40 mgKOH/g, Tm of 100° C., and Tg of 48° C.

Next, 100 parts by mass of the polyester resin, 5 parts by mass of a colorant (component: copper phthalocyanine pigment, color index: Pigment Blue 15:3), and 5 parts by mass of an ester wax ("NISSAN ELECTOL (registered Japanese trademark) WEP-3" manufactured by NOF Corporation, melting point: 73° C.) were mixed using an FM mixer ("FM-10C/I" manufactured by Nippon Coke & Engineering Co., Ltd., capacity: 10 L). The resultant mixture was melt-kneaded using a twin-screw extruder ("PCM-30" manufactured by Ikegai Corp.). The resultant melt-kneaded product was cooled and the cooled melt-kneaded product was coarsely pulverized using a pulverizer ("ROTOPLEX (registered Japanese trademark)" manufactured by Hosokawa Micron Corporation). The resultant coarsely pulverized product was finely pulverized using a mechanical pulverizer ("Turbo Mill T250" manufactured by FREUND-TURBO CORPORATION) under conditions of set particle diameter of 5.6 μm. The resultant finely pulverized product was classified using a classifier ("Elbow Jet Type EJ-LABO" manufactured by Nittetsu Mining Co., Ltd.). Through the above, toner mother particles having a volume median diameter ($D_{50}$) of 6.0 m were obtained.

The obtained toner mother particles had a roundness (shape index) of 0.931, Tm of 98° C., and Tg of 50° C. The obtained toner mother particles had a triboelectric charge of −20 μC/g as measured through friction against standard carrier N-01 (standard carrier for negatively chargeable toner provided by The Imaging Society of Japan). Then, a dispersion of the toner mother particles was prepared and the pH of the dispersion was adjusted to 4. The toner mother particles in the dispersion had a zeta potential of −20 mV as measured using a zeta potential particle size distribution analyzer ("Delsa Nano HC" manufactured by Beckman Coulter, Inc.). It was clear from the measured triboelectric charge and the measured zeta potential that the toner mother particles were anionic.

Next, 100 parts by mass of the toner mother particles (toner mother particles obtained as described above), 0.4 parts by mass of positively chargeable silica particles ("AEROSIL (registered Japanese trademark) 90G" manufactured by Nippon Aerosil Co., Ltd.), and 0.4 parts by mass of the C/S external additive particles P-1 were mixed for 5 minutes using an FM mixer (product of Nippon Coke & Engineering Co., Ltd., capacity: 5 L). The resultant powder was sifted using a 300-mesh sieve (opening size: 48 μm). Through the above, a toner (toner TA-1) including a large number of toner particles was obtained.

<Production of Toners TA-2 to TA-6 and TB-1 to TB-4>

The toners TA-2 to TA-6 and TB-1 to TB-4 were each produced by the same method as that for producing the toner TA-1 in all aspects other than that any of the C/S external additive particles P-2 to P-10 were used.

[Evaluation Methods of Toners]

<Evaluation of Charge Characteristics>

First, 0.5 g of a toner (more specifically, any of the toners TA-1 to TA-6 and TB-1 to TB-4) and 10.0 g of a carrier were put into a polyethylene vessel (capacity: 20 mL). The vessel contents were mixed for 10 minutes at a rotational speed of 100 rpm using NAUTA MIXER manufactured by Hosokawa Micron Corporation in an environment at a temperature of 10° C. and a relative humidity of 10%. A portion of the resultant two-component developer was taken out of the vessel.

A charge of the toner was measured using the two-component developer taken out of the vessel as an evaluation target. Specifically, 0.10 g of the evaluation target was put into a measurement cell of a Q/m meter ("MODEL 210HS-1" manufactured by TREK, INC.). Only the toner included in the evaluation target was sucked through a sieve (wire netting) for 10 seconds. A charge of the toner (unit: μC/g) was calculated by the following equation. Thus, the charge of the toner in an environment of low temperature and low humidity was calculated.

Charge of toner [unit: ρC/g]=total electric charge of sucked toner [unit: μC]/mass of sucked toner [unit: g]

A charge of the toner in an environment of normal temperature and normal humidity was calculated by the same method as the above-described method in all aspects other than that the measurement was performed in an environment at a temperature of 25° C. and a relative humidity of 50%. Also, a charge of the toner in an environment of high temperature and high humidity was calculated by the same method as the above-described method in all aspects other than that the measurement was performed in an environment at a temperature of 32.5° C. and a relative humidity of 80%. A largest value and a smallest value were selected from the thus calculated three values for the charge of the toner, and a difference between the largest value and the smallest value (hereinafter represented by "ΔQ") was calculated to evaluate charge characteristics of the toner.

Evaluation criteria are shown below. Table 4 shows calculation results of the charge of each toner and an evaluation result of the toner.

Good: ΔQ was no greater than 10 μC/g.

Poor: ΔQ was greater than 10 μC/g.

Note that the used carrier was prepared as described below. Specifically, raw materials were used in respective amounts to give the following mole percentages: 39.7% by mole of MnO, 9.9% by mole of MgO, 49.6% by mole of $Fe_2O_3$, and 0.8% by mole of SrO. Water was added to the raw materials and pulverization and mixing were performed for 10 hours using a wet-type ball mill. The resultant mixture was dried and then kept at 950° C. for 4 hours.

The resultant mixture was then pulverized for 24 hours using the wet-type ball mill to prepare a slurry. The slurry was subjected to granulation and drying and then kept at 1,270° C. for 6 hours in an atmosphere having an oxygen concentration of 2%. Thereafter, the resulted granulated product was broken up. Subsequently, particle size adjustment was performed. Through the above, manganese-based ferrite particles (carrier cores) were obtained. The obtained manganese-based ferrite particles had a saturation magnetization of 70 $Am^2/kg$ in an applied magnetic field of 3,000 ($10^3/4\pi \cdot A/m$) and an average particle diameter of 35 μm.

A polyamide-imide resin (copolymer of a trimellitic acid anhydride and 4,4'-diaminodiphenylmethane) was diluted with methyl ethyl ketone to prepare a resin solution. A fluorinated ethylene-propylene copolymer (FEP, fluororesin) and a silicon oxide (in an amount of 2% by mass with respect to a total amount of the resins) were dispersed in the resin solution. Through the above, a carrier coating liquid having a solid content of 150 g was obtained. A mass ratio between the polyamide-imide resin and FEP (polyamide-imide resin: FEP) was 2:8 and a ratio of a solid in the resin solution was 10% by mass.

Then, 10 kg of the above-described manganese-based ferrite particles (carrier cores) were coated with the obtained carrier coating liquid using a fluidized bed coating apparatus ("SPIRA COTA SP-25" manufactured by OKADA SEIKO CO., LTD.). Thereafter, the resultant resin-coated manganese-based ferrite particles were baked at 220° C. for 1 hour. Through the above, the carrier was obtained.

<Evaluation of Heat Resistance>

A polyethylene vessel (capacity: 20 mL) was charged with 3 g of a toner (any of the toners TA-1 to TA-6 and TB-1 to TB-4) and sealed. Tapping treatment was performed on the sealed vessel for 5 minutes and then the vessel was left to stand for 8 hours in a thermostatic chamber set at 60° C. Thereafter, the toner was taken out of the vessel and cooled to room temperature (approximately 25° C.). Through the above, an evaluation target was obtained.

The obtained evaluation target was placed on a 300-mesh sieve (opening size: 48 μm) of a known mass. A mass of the sieve including the evaluation target placed thereon was measured to determine a mass of the toner before sifting. The sieve was then set in POWDER TESTER (registered Japanese trademark, product of Hosokawa Micron Corporation) and shaken for 30 seconds at a rheostat level of 5 in accordance with a manual of POWDER TESTER to sift the evaluation target. After sifting, a mass of toner that did not pass through the sieve was measured. An aggregation rate (unit: % by mass) was calculated from the mass of the toner before sifting and the mass of the toner after sifting by the following equation. Note that "mass of toner after sifting" in the following equation represents the mass of the toner that did not pass through the sieve and remained on the sieve after sifting.

Aggregation rate=100×(mass of toner after sifting/mass of toner before sifting)

Evaluation criteria are shown below. Table 4 shows a calculation result of the aggregation rate of each toner and an evaluation result of the toner.

Good: Aggregation rate was no greater than 10%.

Poor: Aggregation rate was greater than 10%.

[Evaluation Results of Toners]

Table 4 shows evaluation results of each toner. In Table 4, a charge of the toner in an environment of low temperature and low humidity is shown in the column titled "L/L", a charge of the toner in an environment of normal temperature and normal humidity is shown in the column titled "N/N", and a charge of the toner in an environment of high temperature and high humidity is shown in the column titled "H/H".

TABLE 4

| | | Charge characteristics | | | | | Heat resistance | |
|---|---|---|---|---|---|---|---|---|
| | | Charge of toner (μC/g) | | | ΔQ | Evaluation | Aggregation rate | Evaluation |
| | Toner | L/L | N/N | H/H | (μC/g) | result | (%) | result |
| Example 1 | TA-1 | 30 | 25 | 21 | 9 | Good | 3 | Good |
| Example 2 | TA-2 | 30 | 27 | 25 | 5 | Good | 6 | Good |
| Example 3 | TA-3 | 30 | 28 | 26 | 4 | Good | 9 | Good |
| Example 4 | TA-4 | 30 | 26 | 21 | 9 | Good | 2 | Good |
| Example 5 | TA-5 | 30 | 27 | 26 | 4 | Good | 9 | Good |
| Example 6 | TA-6 | 30 | 25 | 22 | 8 | Good | 4 | Good |
| Comparative example 1 | TB-1 | 30 | 23 | 19 | 11 | Poor | 1 | Good |
| Comparative example 2 | TB-2 | 30 | 28 | 27 | 3 | Good | 11 | Poor |
| Comparative example 3 | TB-3 | 30 | 20 | 10 | 20 | Poor | 13 | Poor |
| Comparative example 4 | TB-4 | 30 | 29 | 28 | 2 | Good | 20 | Poor |

The toners TA-1 to TA-6 (more specifically, toners according to Examples 1 to 6) each had the above-described basic features. Specifically, the toners TA-1 to TA-6 each included a plurality of toner particles. The toner particles each included a toner mother particle containing a polyester resin and an external additive adhering to a surface of the toner mother particle. The external additive included a plurality of external additive particles having a core-shell structure. The external additive particles having the core-shell structure each included a core particle and a plurality of shell particles adhering to a surface of the core particle. The shell particles had a number average primary particle diameter of no greater than 0.40 times a number average primary particle diameter of the core particles. The core particles and the shell particles each contained a resin. The core particles had a hydrophobicity degree of at least 30%. The shell particles had a hydrophobicity degree of no greater than 5%. The external additive particles having the core-shell structure had a hydrophobicity degree of at least 15% and no greater than 25%.

As shown in Table 4, the toners TA-1 to TA-6 each had ΔQ of no greater than 10 μC/g. Also, the toners TA-1 to TA-6 each had an aggregation rate of no greater than 10%.

By contrast, the toners TB-1 to TB-4 (more specifically, toners according to Comparative examples 1 to 4) each did not have the above-described basic features. Specifically, the hydrophobicity degree of the C/S external additive particles in the toner TB-1 was low. Also, ΔQ of the toner TB-1 was greater than 10 μC/g.

The hydrophobicity degree of the C/S external additive particles in the toner TB-2 was high. Also, the aggregation rate of the toner TB-2 was greater than 10%.

The hydrophobicity degree of the C/S external additive particles in the toner TB-3 was excessively low. Also, ΔQ of the toner TB-3 was greater than 10 μC/g. Further, the aggregation rate of the toner TB-3 was greater than 10%.

The external additive in the toner TB-4 included no C/S external additive particles. Also, the hydrophobicity degree of the external additive particles was excessively high. Further, the aggregation rate of the toner TB-4 was greater than 10%.

What is claimed is:

1. A toner comprising a plurality of toner particles, wherein the toner particles each include a toner mother particle containing a polyester resin and an external additive adhering to a surface of the toner mother particle, the external additive includes a plurality of external additive particles having a core-shell structure, the external additive particles having the core-shell structure each include a core particle and a plurality of shell particles adhering to a surface of the core particle, the shell particles have a number average primary particle diameter of no greater than 0.40 times a number average primary particle diameter of the core particles, the core particles and the shell particles each contain a resin, the core particles have a hydrophobicity degree of at least 30%, the shell particles have a hydrophobicity degree of no greater than 5%, and the external additive particles having the core-shell structure have a hydrophobicity degree of at least 15% and no greater than 25%.

2. The toner according to claim 1, wherein a ratio of an area of surface regions of the core particle covered by the shell particles to an entire surface area of the core particle is at least 20% and no greater than 30%.

3. The toner according to claim 1, wherein the core particles and the shell particles each contain a crosslinked acrylic acid-based resin, the crosslinked acrylic acid-based resin contained in the core particles is a copolymer of a cross-linking agent and at least one acrylic acid-based monomer including a (meth)acrylic acid alkyl ester that has an alkyl group having a carbon number of at least 4 and no greater than 8, the crosslinked acrylic acid-based resin contained in the shell particles is a copolymer of the cross-linking agent and a (meth)acrylic acid alkyl ester that has an alkyl group having a carbon number of at least 1 and no greater than 2, and the cross-linking agent is a compound having at least two vinyl groups within a molecule thereof.

4. The toner according to claim 3, wherein the crosslinked acrylic acid-based resin contained in the core particles is a copolymer of the cross-linking agent and at least one acrylic acid-based monomer including n-butyl (meth)acrylate, and the crosslinked acrylic acid-based resin contained in the shell particles is a copolymer of the cross-linking agent and methyl (meth)acrylate.

5. The toner according to claim 1, wherein the core particles contain a crosslinked styrene-based resin, and the shell particles contain a crosslinked acrylic acid-based resin.

6. The toner according to claim 1, wherein the resin contained in the core particles is a copolymer of a cross-linking agent and at least one acrylic acid-based monomer, and the resin contained in the shell particles is a copolymer of a cross-linking agent and an acrylic acid-based monomer.

7. The toner according to claim 1, wherein the resin contained in the core particles is a crosslinked styrene-acrylic acid-based resin, and the resin contained in the shell particles is a crosslinked acrylic acid-based resin.

8. The toner according to claim 1, wherein at least one of the shell particles is present between the toner mother particle and each of the core particles.

9. The toner according to claim 1, wherein an amount of the external additive is at least 0.5 parts by mass and no greater than 10 parts by mass relative to 100 parts by mass of the toner mother particles.

10. The toner according to claim 1, wherein the toner mother particles each include a toner core and a shell layer covering a surface of the toner core, and the shell layer contains a styrene-acrylic acid-based resin that has a unit having at least one species of alcoholic hydroxyl group derived from 2-hydroxyethyl acrylate, 2-hydroxypropyl acrylate, 2-hydroxyethyl methacrylate, or 2-hydroxypropyl methacrylate.

* * * * *